United States Patent [19]

Friesner et al.

[11] Patent Number: 4,566,204

[45] Date of Patent: Jan. 28, 1986

[54] TREATING WEAK-TO MEDIUM-ACTIVE ION EXCHANGER RESINS IN A DRYING VESSEL

[75] Inventors: Karl Friesner, Bamberg; Dietmar Bege, Erlangen; Dietmar Erbse, Rodenbach; Siegfried Meininger, Altenstadt, all of Fed. Rep. of Germany

[73] Assignee: Kraftwerk Union Aktiengesellschaft, Mülheim, Fed. Rep. of Germany

[21] Appl. No.: 653,933

[22] Filed: Sep. 24, 1984

[30] Foreign Application Priority Data

Sep. 29, 1983 [DE] Fed. Rep. of Germany ..... 3335394

[51] Int. Cl.[4] ..... F26B 3/20; F26B 5/04

[52] U.S. Cl. ..... 34/15; 34/39; 34/40; 34/92; 252/632

[58] Field of Search ..... 34/15, 39, 40, 73, 79, 34/92, 177; 252/626, 631, 632, 633

[56] References Cited

U.S. PATENT DOCUMENTS

| | | | |
|---|---|---|---|
| 2,765,236 | 10/1956 | Blaine | 34/15 |
| 3,672,068 | 6/1972 | Wilkison | 34/15 |
| 4,008,171 | 2/1977 | Tiepel et al. | 252/626 |
| 4,123,380 | 10/1978 | Norell | 252/633 |
| 4,497,120 | 2/1985 | Laemmermann et al. | 34/15 |
| 4,499,669 | 2/1985 | Haeck | 34/177 |

*Primary Examiner*—Albert J. Makay
*Assistant Examiner*—David W. Westphal
*Attorney, Agent, or Firm*—Herbert L. Lerner; Laurence A. Greenberg

[57] ABSTRACT

Treating weak-to medium-active ion exchanger resins which are dried in a drying container by means of heat and in a vacuum, before they are transported into a storage container, the heat being introduced by heat conduction via the drying container into the ion exchanger resins. The heat is conducted via metallic heat transfer surfaces into the bulk of the resins leaving a core of at most 100 mm thickness. Steam from the moisture in the resin is conducted at the same time into a condenser via a discharge line, with an underpressure of 300 mbar or less.

7 Claims, 3 Drawing Figures

TREATING WEAK-TO MEDIUM-ACTIVE ION EXCHANGER RESINS IN A DRYING VESSEL

BACKGROUND OF THE INVENTION

1. Field of the Invention

The invention relates to a method for treating weak- to medium-active ion exchanger resins which are dried in a drying vessel by means of heat and in a vacuum before they are transported into a storage tank, the heat being introduced by heat conduction via the drying vessel into the ion exchanger resin.

2. Description of the Prior Art

U.S. Pat. No. 4,008,171 discloses in which ion exchanger resins are dried in a fluidized bed container in several stages. In the last drying stages, superheated steam with temperatures as high as 260° C. (500° F.) or more are conducted through the resins. This system requires a suitable steam source and the use of this steam increases the possibility of undesirable moisture in the product.

SUMMARY OF THE INVENTION

An object of the invention is to reduce the amount of equipment required for drying resin and to more effectively increase the degree of drying. In this regard, it must be taken into consideration that the wet resins form, as a piled bed, a relatively compact mass thus impeding, the gas required for drying the resin, at least at the beginning, by the high flow resistance of the wet resin. In addition, the thermal stress of the resins is to be kept small, i.e. at a low temperature, to avoid thermal decomposition of the resins.

With the foregoing and other objects in view, there is provided, in accordance with the invention, a method for treating weak-to medium-radioactive ion exchanger resins in a drying container by means of heat and in a vacuum which comprises, passing wet radioactive ion exchanger resin into a drying container having internal metallic heat conducting surfaces for the transfer of heat with the heat conducting surfaces extending into the bulk of the resin leaving a core of at most 100 mm thickness, introducing heat by heat conduction via the metallic heat transfer surfaces into the resin while maintaining the drying chamber under a pressure of 300 mbar or less to effect vaporization of water in the wet resin, and discharging water vapor from the drying container through a discharge line into a condenser maintained at a pressure of 300 mbar or less to effect condensation of the water vapor.

Other features which are considered as characteristic for the invention are set forth in the appended claims.

Although the invention is illustrated and described herein as embodied treating weak-to medium-active ion exchanger resins in a drying vessel, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawing, in which.

DETAILED DESCRIPTION OF THE INVENTION

Figure 1:
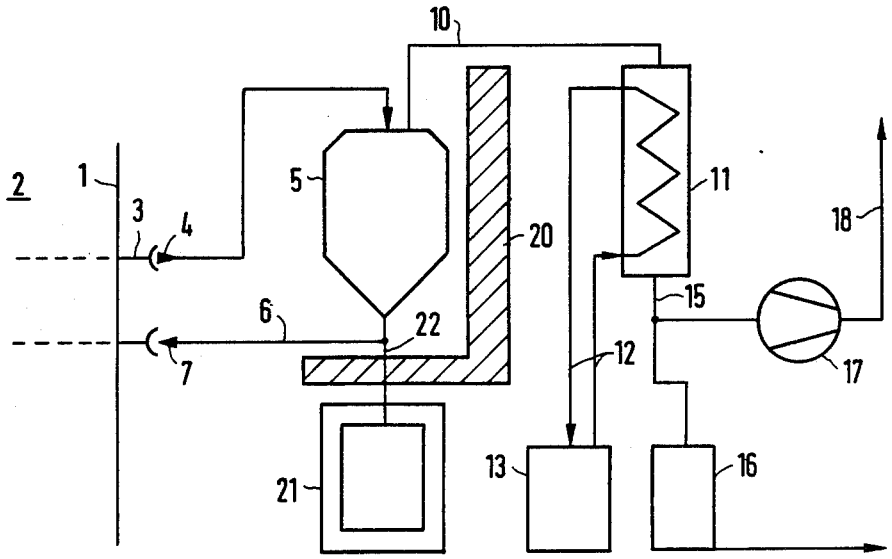
FIG. 1 diagrammatically illustrates apparatus for carrying out the method in accordance with the invention in which spent wet resins from a nuclear installation are sent to a drying container with an outlet at the bottom for the return of drained water to the installation and later for the discharge of dried resin in a thick-walled container. Heat is introduced by heat conduction via metallic heat transfer surfaces into the resin under vacuum to vaporize the water in the wet resin. The water vapor is removed from the drying container, condensed and the condensate collected.
Figure 2:
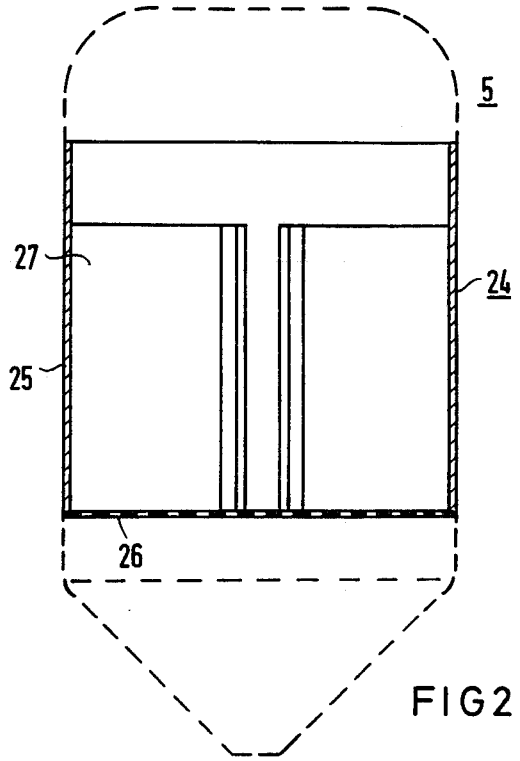
FIG. 2 is a side view to particularly show metallic heat transfer surfaces in the form of a hollow cylinder with ribs extending therefrom into the resin leaving a small central core.

According to the invention, heat is conducted via metallic heat transfer surfaces extending into the bulk of the resin leaving a core of at most 100 mm thickness. Water vapor vaporized from the water in the wet resin is simultaneously conducted from the drying container through a discharge line into a condenser with an underpressure of 300 mbar or less.

Thus, in the invention, the moisture in the resin is converted to steam which is discharged directly from the drying container. The heat which increases the formation of steam during the drying process is introduced directly into the resin bed to be dried via the drying container, and specifically extends into the resin such that only a small core without contact with heat transfer surface remains.

The magnitude of the temperature is determined by the underpressure of the vacuum line which is at most equal to one half the normal pressure but can also be substantially lower than 300 mbar. In any event, the temperature of heat conduction to effeet vaporization of water in the resin can be kept low by operating under a greater vacuum, i.e. lower pressure. Resins are stable at low temperatures and will not decompose and as a consequence flammable amine/air mixtures cannot be formed. Because of the small requirements as to apparatus, the vacuum system can be compact and optionally mobile. The introduction of heat by heat conduction makes the drying more economical and, above all, more gentle. The heat can be generated in various ways, for instance electrically, by steam or by heating oil. A low temperature heat carrier, for instance warm water, is particularly advantageous.

In a particularly advantageous embodiment of the invention, a filter container containing the ion exchanger resins is used as the drying container and is connected for this purpose temporarily with a heating system and to a vacuum line. Thereby, the system for transporting the resins into another drying container and an additional drying container are eliminated, which results in appreciable savings in cost. Only a vacuum connection to the filter container is required. A heating device in the form of a heating jacket can readily be put on or flipped over or can be wound on in the form of flexible heating lines onto the filter container.

The drying according to the invention can further be improved by condensing the water vapor or steam from the drying container in a condenser at a temperature below 10° C. This permits the rise of a substantially smaller vacuum pump to generate the necessary vacuum or underpressure because the pump now is required to draw off only unavoidable small amounts of gases due primarily to leaks, and no longer need to exhaust large steam volumes of the water vapor which are effectively condensed to water at the low temperature.

The dried ion exchanger resins can be filled from the drying container into a thick-walled container and sealed off in the latter gas tight. The ion exchanger resins are preferably dried to a residual moisture of 5% by weight or less. The above-mentioned container which may optionally include an additional shielding container, may be utilized for interim storage and under some circumstances is also suitable as a variant for the ultimate storage of the radioactive resins. In the case of the so-called interim storage, the following advantages are further obtained with the invention:

The radiolysis gas formation is minimized by substantial freedom of water

Elimination of microbial processes with low activity inventory due to low residual moisture Local corrosion by contact between resin and material is avoided The dry, i.e. flowable resins can readily be transferred to another container by underpressure transportion when subjecting the resins at a later time to conditioning.

Apparatus suitable for carrying out the method according to the invention includes a drying container which encloses the bulk of the resin with metallic heat transfer surfaces except for a core of at most 100 mm and which has a heating jacket. The smaller the core, the more effective is the heat transfer from the heated drying container to the resins to be dried. To this end, the drying container advantageously has internal ribs in order to reduce the core region of a larger container to the above-mentioned value. Also, the ribs can contain heating elements.

It is further advantageous if the discharge line for the water vapor leads to a condenser to which a vacuum pump is connected, with at least the same net width as the thickness of the core. This keeps the flow resistance and thereby the pump output within limits, because with the low pressures which characterize the method according to the invention, the steam leaving the resins occupies a relatively large volume.

The invention will be described in greater detail in an embodiment example in the following and illustrated in simplified form in the drawing.

In FIG. 1, the wall 1 of a nuclear installation 2 can be seen into which ion exchanger resins are charged where they become contaminated with weak or medium activity. The spent resins are flushed out with water and transported via a line 3 having a plug-in coupler 4 to a drying container 5. The water used for the transportation can be returned through a return line 6 with a plug-in coupler 7 into the nuclear installation 2.

The drying container is designed for receiving about 1 $m^3$ wet resins. A vacuum connection 10 at its top side leads to a condenser 11. The condenser 11 is a heat exchanger connected on one side via lines 12 to a cooling unit 13. The cooling unit 13 cools a glycol-water mixture used as a coolant, in the case of a mobile installation, to −2° to −5° C. Thereby, the steam which leaves the drying container 5 via the line 10 and enters the condenser 11 is condensed. The outlet 15 of the condenser 11 leads to a condensate container 16. In the case of stationary installations, the cooling can also be accomplished by the existing cooling water network, by well water or the like.

A vacuum pump 17 is connected on the suction side, and on the discharge side to the discharge pressure line 18 which leads to the building exhaust air. The vacuum pump 17 generates on its intake side a vacuum of about 75 to 150 mbar.

A thick-walled container 21 of cast ball graphite GGG40 is arranged below the drying container 5 which is equipped with a shield 20. Container 21 receives the resins fed from the drier via a fall line 22, after they are dried.

Figure 3:
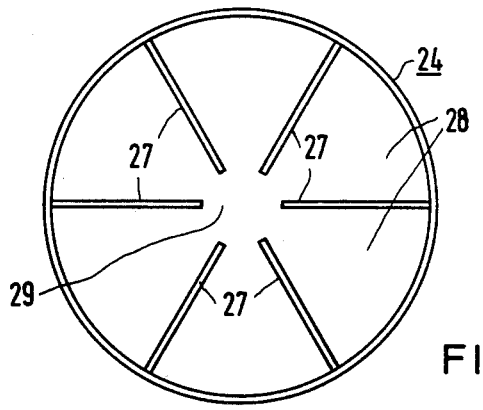
FIG. 3 is a top view of FIG. 2.

The drying container 5 encloses with good heat conduction an insert 24, shown in FIG. 3. Insert 24 has a cylindrical jacket 25 and a screen bottom 26 of austenitic material with a wall thickness of 5 mm. Ribs 27, 3 mm thick, extend inwardly from the jacket 25 as shown in FIG. 3. The cylindrical volume of the insert 24 which receives the wet resins to be dried is divided into sectors 28 each of relatively small volume. The core region 29 in the center of the insert 24 has a diameter of only 60 mm.

The heating of the drying container 5 with the insert 24 is preferably controlled electrically so that a temperature of 60° C. can be maintained accurately within a few degrees. This determination can be made by a temperature measuring device, not shown, preferably with a thermo-couple inserted into the resin bed. Low-temperature thermal energy can be fed-in, for instance, with warm water at 80° C., so that overheating is impossible. The water flows through a double jacket, not shown, of the drying container 5. At a low temperature of 60° C. with an underpressure of 300 mbar or less which is generated by the pump 17, a relatively large resin volume can be dried to a residual moisture of at most 5% by weight in a relatively short time (about 20 hours). For the same temperature, the drying time is shorter by direct application of heat by conduction to small volumes of resin. For instance, the ribs 27 shorten the drying time to about one half.

The water vapor from drying container 5 is drawn via the line 10 into the condenser 11 where it is condensed. Condenser 11 has a cross section of 200 $cm^2$ and is covered with heat insulation. The remaining gases are discharged by the vacuum pump 17 into the system of the building exhaust air. This quantity of gas is small as compared to the steam volume discharging into the condenser.

After drying is completed, the resins are transferred from the drying container 5 through line 22 into the pouring container 21 and sealed there tightly, for instance by means of a welded-on intermediate cover. In this form, they can be interim-stored without danger of impermissible change. The dried resins, however, can also be made leach-resistant by embedment into bitumen, and therefore capable of ultimate storage.

There are claimed:

1. Method for treating weak-to medium-radioactive ion exchanger resins in a drying container by means of heat and in a vacuum which comprises, passing wet radioactive ion exchanger resin into a drying container enclosing an insert made of metal with good heat conduction, having a cylindrical jacket, a screen bottom, and radial ribs extending inwardly from the jacket into the bulk of the resin leaving a core of at most 100 mm thickness, and dividing the cylindrical volume of the insert which receives the wet resins to be dried into sectors each of small volume relative to the volume of the drying chamber to provide a large metal heating surface of the insert in contact with the resin in the drying chamber and to subdivide the resin in the drying chamber into small volumes of sector shape with each small sector shaped volume of resin in direct heat transfer contact on three sides with the metal heating surface of the insert, introducing heat by heat conduction via the metallic heat transfer surfaces into the resin while maintaining the drying chamber under a pressure of 300 mbar or less to effect vaporization of water in the wet resin unitl the resin is dried to a residual moisture of at most 5% by weight, and discharging water vapor from the drying container through a discharge line into a condenser maintained at a pressure of 300 mbar or less to effect condensation of the water vapor.

2. Method according to claim 1, wherein the ion exchanger resins are introduced in the form of an aqueous suspension into the drying container.

3. Method according to claim 1, wherein a filter container containing the ion exchanger resins is used as the drying container.

4. Method according to claim 1, wherein the water vapor from the drying container is condensed in a condenser at a temperature below 10° C.

5. Method according to claim 1, wherein the dried ion exchanger resin from the drying container is discharged into a thick-walled container and is sealed in the latter gas-tight.

6. Method according to claim 1, wherein heat is supplied to the metallic heat transfer surfaces by an outer heating jacket around the drying container.

7. Method according to claim 6, wherein the water vapor from the drying container flows through a discharge line which leads to a condenser to which a vacuum pump is connected with about the same net width as the thickness of the core.

* * * * *